US008212478B2

(12) United States Patent
Greuel et al.

(10) Patent No.: US 8,212,478 B2
(45) Date of Patent: Jul. 3, 2012

(54) DIELECTRIC BARRIER DISCHARGE LAMP

(75) Inventors: Georg Greuel, Roetgen (DE); Wolfgang Schiene, Wurselen (DE); Norbert Braun, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 301 days.

(21) Appl. No.: 12/595,064

(22) PCT Filed: Apr. 14, 2008

(86) PCT No.: PCT/IB2008/051403

§ 371 (c)(1), (2), (4) Date: Oct. 8, 2009

(87) PCT Pub. No.: WO2008/129440

PCT Pub. Date: Oct. 30, 2008

(65) Prior Publication Data

US 2010/0164410 A1 Jul. 1, 2010

(30) Foreign Application Priority Data

Apr. 18, 2007 (EP) ..... 07106441

(51) Int. Cl.
*H01J 11/00* (2012.01)

(52) U.S. Cl. ..... 313/607; 313/634

(58) Field of Classification Search ..... 313/567, 313/621, 581, 234, 607, 634, 609, 17
See application file for complete search history.

(56) References Cited

U.S. PATENT DOCUMENTS

| | | | | |
|---|---|---|---|---|
| 5,432,398 | A | 7/1995 | Kogelschatz | |
| 5,763,999 | A * | 6/1998 | Matsuno et al. | 313/573 |
| 7,675,237 | B2 * | 3/2010 | Schiene et al. | 313/607 |
| 7,687,997 | B2 * | 3/2010 | Gaertner et al. | 313/634 |
| 2003/0011321 | A1 | 1/2003 | Berlinghof et al. | |
| 2003/0111960 | A1 | 6/2003 | Doll et al. | |
| 2004/0021411 | A1 | 2/2004 | Doll | |

FOREIGN PATENT DOCUMENTS

WO 2006006139 A1 1/2006

* cited by examiner

*Primary Examiner* — Thuy Vinh Tran

(57) ABSTRACT

A dielectric barrier discharge (DBD-) lamp (1) comprising a discharge volume (2) which is delimited by a first and a second wall (4, 5) is disclosed, wherein both walls (4, 5) are exposed to different electrical potentials by means of a power supply (11) for exciting a gas discharge within the discharge volume (2). By providing at least one electrically conductive ignition aid or igniter which extends within the discharge volume (2) and which electrically contacts the first and the second wall (4, 5) with each other, a significant reduction of the initial ignition voltage of the lamp (1) can be obtained, especially after long pauses of operation of the lamp (1).

10 Claims, 3 Drawing Sheets

DIELECTRIC BARRIER DISCHARGE LAMP

FIELD OF THE INVENTION

The invention relates to a dielectric barrier discharge (DBD-) lamp comprising a discharge volume, which is delimited by a first and a second wall, wherein both walls are exposed to different electrical potentials by means of a power supply for exciting a gas discharge within the discharge volume and wherein the lamp is provided with an ignition aid.

BACKGROUND OF THE INVENTION

The basic principle of these lamps is the generation and emission of radiation by means of a dielectric barrier discharge. Usually, at least one of the two electrodes of such a lamp is located outside the discharge volume. The discharge volume comprises a discharge gas, especially at or around the lamp envelope, wherein the energy supply is accomplished by capacitive coupling through the walls of the lamp envelope into the discharge volume, in order to initiate within this volume the gas discharge and the excitation and emission of radiation.

Typically, these lamps have a cylindrical, a dome shaped or a coaxial construction and they are cooled by means of an internal and/or an external flow of water. In case of a coaxial design the lamp usually comprises an inner and an outer quartz tube which both are coaxially arranged to each other and are melted together at both their axial ends so that an annular discharge volume is delimited between both.

Generally, such dielectric barrier discharge lamps are used as an alternative to conventional mercury based discharge lamps in a wide area of applications, where a radiation of a certain wavelength has to be generated for a variety of purposes. Some applications are for example the generation of ultraviolet (UV) radiation with wavelengths oaf between about 170 nm and about 380 nm for industrial purposes such as waste water treatment, disinfection of gases and fluids, especially of drinking water, dechlorination or production of ultra pure water, activation and cleaning of surfaces, curing of lacquers, inks or paints, ozone generation, or for liquid crystal display (LCD) backlighting or photocopiers and others.

Furthermore, dielectric barrier discharge lamps are of increasing importance especially as a source for generating and/or emitting high intensity and high power ultraviolet (UV) radiation in a narrow and well defined spectral range with high efficiency and high radiation intensity.

WO 2006/006139 discloses a dielectric barrier discharge lamp comprising a discharge gap being at least partly formed and/or surrounded by at least an inner wall and an outer wall, wherein at least one of the walls is a dielectric wall and at least one of the walls has an at least partly transparent part, a filling located inside the discharge gap, at least a first electrical contacting means for contacting the outer wall and a second electrical contacting means for contacting the inner wall, and at least one multifunctional means which is arranged adjacent to the discharge gap and which on the one hand serves as an improved and optimized ignition aid, especially for initial ignition or ignition after a long pause, and on the other hand serves at least as guiding means for easily arranging two walls towards each other, thereby forming an optimized discharge gap especially for coaxial dielectric barrier discharge lamps.

SUMMARY OF THE INVENTION

An object underlying the invention is to provide a dielectric barrier discharge lamp as mentioned in the introductory part above that comprises an ignition aid or igniter or starting aid in a very simple construction and which is easy to manufacture.

The object is solved according to claim 1 by a dielectric barrier discharge lamp comprising a discharge volume which is delimited by a first and a second wall, wherein both walls are exposed to different electrical potentials by means of a power supply for exciting a gas discharge within the discharge volume, and at least one electrically conductive ignition aid or igniter which extends within the discharge volume and which electrically contacts the first and the second wall with each other.

This solution has the advantage, that in contrary to the lamp as disclosed in the above WO 2006/006139, the inner and the outer wall surrounding the discharge gap need not to be changed with respect to their shape and form or any extension or depression, so that the lamp according to the invention is very simple in construction and easy to manufacture.

Another advantage of this solution is, that by providing the at least one electrically conductive ignition aid or igniter within the discharge volume, the voltage amplitude needed for initial ignition can be significantly decreased in comparison to known such ignition aids. Furthermore, a reliable ignition especially after long operating pauses is achieved as well. Due to the fact that there is no need for changing the shape and form of the discharge volume, the volume and especially its width can be optimized specifically with respect to a desired maximum lamp efficiency.

The subclaims disclose advantageous embodiments of the invention.

The materials of the ignition aid or igniter according to subclaims 2 and 3 are especially effective for reducing the necessary voltage amplitude for the initial ignition of the lamp.

The embodiment according to subclaim 4 has the advantage that the related ignition aid or igniter can be mechanically fixed or fastened within the discharge volume very easily.

Subclaims 5 to 8 disclose various shapes and forms of the ignition aid or igniter which are easy to manufacture and easy to install within the related discharge volume of a DBD lamp.

The embodiment according to subclaim 9 has the advantage, that the ignition aid or igniter does not substantially shadow the radiation which is generated in the active area of the discharge volume.

Further details, features and advantages of the invention become obvious from the following description of preferred and exemplary embodiments of the inventions with respect to the drawings.

DETAILED DESCRIPTION OF EMBODIMENTS

Figure 1:
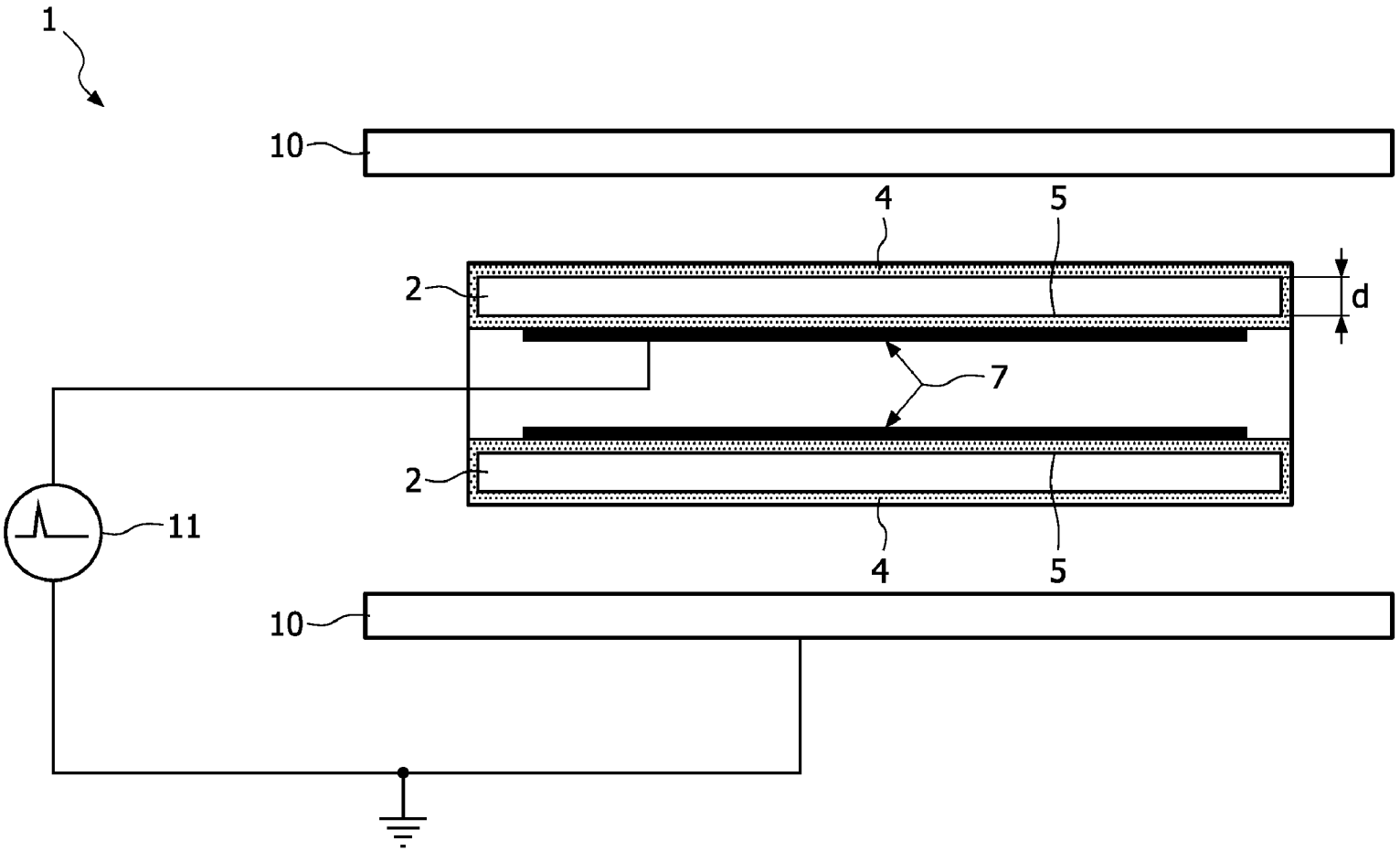
FIG. 1 shows a longitudinal sectional view of substantial parts of a coaxial DBD-lamp.

FIG. 1 shows in a longitudinal sectional and schematic view substantial parts of a coaxial dielectric barrier discharge lamp 1. The lamp 1 comprises a first outer wall 4 and a second inner wall 5 between which a discharge volume 2 in the form of a gap having a width d is delimited for enclosing a discharge gas.

The outer and the inner wall 4, 5 is preferably provided by a coaxial arrangement of a first outer tube and a second inner tube which are connected together at their axial ends, so that the discharge volume 2 in the form of a ring shaped discharge gap or space (lamp envelope) is delimited between both.

At least one of the walls 4, 5 is made from a dielectric material such as glass, quartz or ceramic, and at least one of the walls 4, 5 has an at least partly transparent region for emitting the radiation generated by the gas discharge inside the discharge volume 2 of the lamp 1.

Furthermore, the lamp 1 comprises two electrodes 7, 10 which are connected with a supply voltage source 11 for supplying electrical energy and for exposing both walls 4, 5 to different electrical potentials so that a gas discharge is excited within the discharge volume.

More in detail, a first electrical electrode 7 is provided for example in the form of a grid of electrical conductors (which grid is radiation transparent) or a metallic plate which is applied onto the outer surface of the inner wall 5 (i.e. of the second inner tube) of the discharge lamp, so that it can be contacted with the supply voltage source 11. The second electrical electrode 10 is provided for example in the form of a third outer electrically conductive tube or cylinder that coaxially surrounds the first and the second tube of the lamp 1. Depending on the proposed application of the lamp 1, the second electrode 10 can be attached to the outside of the outer wall 4 and is at least partly transparent for the radiation to be emitted by the lamp. However, for example in case of treating an electrically conductive fluid which is guided between the second and the third tube, the second electrical electrode 10 need not to be radiation transparent and is placed apart from the lamp as indicated in FIG. 1.

Finally, it shall be mentioned that preferably the inner surface of the outer wall 4 and/or the inner wall 5 of the discharge volume 2 can be at least partly coated with a luminescent layer (not shown, for example a phosphor layer) for transferring the wavelength of the (primary) radiation of the gas discharge to another wavelength of the radiation as desired which is emitted by the lamp 1.

It was found that the required initial ignition voltage of such a lamp, especially of a highly efficient and high power DBD lamp 1, is significantly larger than the optimal operating (peak) voltage amplitude of the lamp. Therefore, in order to achieve a reliable start-up of such known lamps, additional auxiliary electrodes or temporary voltage overshoots are usually necessary which lead to a more complex and more expensive supply voltage source 11 or lamp driver.

FIGS. 2A and 2B to 7A and 7B schematically show each in a longitudinal view (A) and in a cross sectional view (B) substantial components of a first to sixth embodiment, respectively, of a dielectric barrier discharge lamp 1 according to the invention, each comprising at least one ignition aid or igniter (also called starting aid) 31 to 34, respectively, with which the voltage amplitude which is necessary for an initial ignition of the DBD lamp 1, is significantly reduced in comparison to known such DBD lamps, especially after long operating pauses of the DBD lamp 1.

Generally, the ignition aid or igniter 31 to 34 is electrically conductive, and has a form of, for example, a wire, a rod, a clamp, a ring or a disk, or a similar form which is shaped in such a way that it contacts the inner wall 5 and the outer wall 4, so that a local short circuit of the discharge is achieved and a source for electrons which are supplied by field emission is provided.

More in detail, the ignition aid or igniter 31 to 34 is made of a material with a low electron affinity and a low energy barrier (low work function) for the release of electrons, utilizing field emission of electrons from the material of the ignition aid or igniter 31 to 34 into the discharge volume 2. The material is preferably selected from the group of metals, and preferably pre-treated in such a way that non-conductive surface oxides are removed from the ignition aid or igniter 31 to 34 prior to the closing of the DBD lamp 1, wherein these non-conductive surface oxides are removed e.g. by thermal treatment in a non-oxidizing atmosphere.

The ignition aid or igniter 31 to 34 works by producing an electrical field with a component in a parallel direction and—depending on the particular shape of the igniter—a component in a vertical direction relative to the axial extension of the discharge volume 2. At least one of these electrical field components generates a field at the surface of the ignition aid or igniter 31 to 34 that is large enough to generate field emission of electrons from the ignition aid or igniter 31 to 34 into the discharge volume 2.

Preferably, the ignition aid or igniter 31 to 34 comprises a heterogeneous body comprising an elastic inner material and an overcoat comprising a material as mentioned above which is suitable for the emission of electrons. By means of elastic forces exerted by the elastic inner material, the ignition aid or igniter 31 to 34 is mechanically fixed between the inner wall 5 and the outer wall 4 of the discharge volume 2.

In the following, six exemplary embodiments of the invention are explained with reference to FIGS. 2A to 7B, respectively. In these Figures, the same or similar or corresponding parts and components are denoted with the same or corresponding reference numerals as in FIG. 1, so that these parts and components need not to be explained again, but reference is made with respect to these parts and components to FIG. 1 and the related explanations above.

Figure 2A:
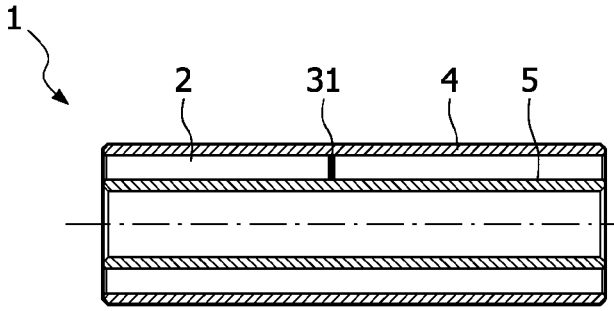
FIGS. 2A and 2B shows a longitudinal and a cross sectional view of substantial parts of a first embodiment of a coaxial DBD-lamp according to the invention.
Figure 2B:
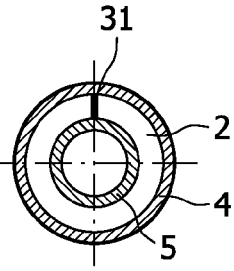

FIGS. 2A and 2B shows a first embodiment of a dielectric barrier discharge lamp 1 according to the invention which comprises a first ignition aid or igniter 31 in the form of a straight electrically conductive rod or wire 31 which extends in a radial direction of the coaxial arrangement of the inner and the outer tube, and between the inner wall 5 and the outer wall 4 within the discharge volume 2, at substantially any position along the axial length of the lamp 1.

Figure 3A:
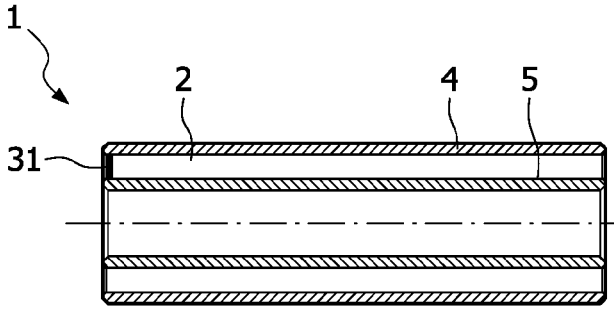
FIGS. 3A and 3B shows a longitudinal and a cross sectional view of substantial parts of a second embodiment of a coaxial DBD-lamp according to the invention.
Figure 3B:
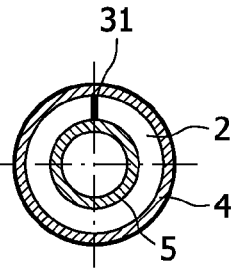

FIGS. 3A and 3B exemplary shows a second embodiment of such a DBD lamp 1 in which the first ignition aid or igniter 31 is again provided in the form of a straight electrically conductive rod or wire 31 which as well extends in a radial direction of the coaxial arrangement of the inner and the outer tube, and between the inner wall 5 and the outer wall 4 within the discharge volume 2, however, at one of the axial ends of the lamp 1 at a position, in which the inner and the outer tube are sealed together. In this position, the ignition aid or igniter 31 is located substantially outside the active area of the lamp, in which the radiation is excited so that the radiation is not disturbed or shadowed by the ignition aid or igniter 31.

Figure 4A:
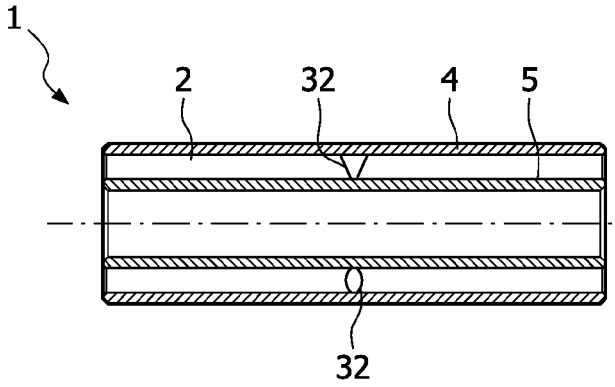
FIGS. 4A and 4B shows a longitudinal and a cross sectional view of substantial parts of a third embodiment of a coaxial DBD-lamp according to the invention.
Figure 4B:
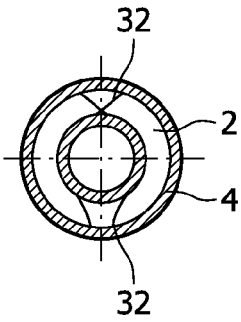

FIGS. 4A and 4B exemplary shows a third embodiment of a DBD lamp 1 according to the invention, comprising a second ignition aid or igniter 32 in the form of an open clamp 32 which is shaped such that it circumferentially extends along the ring-shaped discharge volume 2 and electrically connects the inner wall 5 with the outer wall 4. An advantage of this embodiment is, that the clamp 32 can be easily mounted and reliably fixed to the interior of the discharge volume 2 at substantially any position along the axial length of the lamp 1 by means of elastic forces which are exerted by the clamp 32 against the adjacent walls 4, 5 of the discharge volume 2.

Figure 5A:
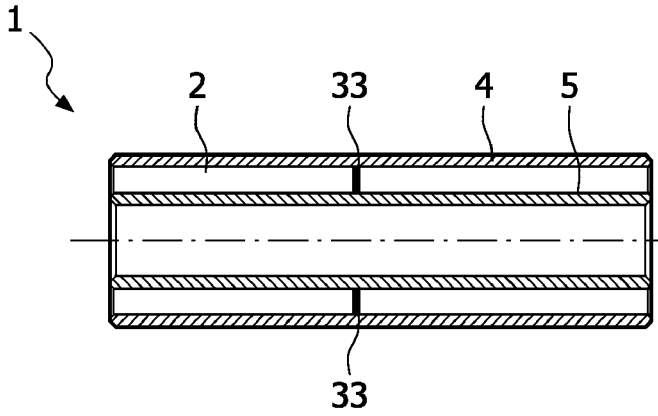
FIGS. 5A and 5B shows a longitudinal and a cross sectional view of substantial parts of a fourth embodiment of a coaxial DBD-lamp according to the invention.
Figure 5B:
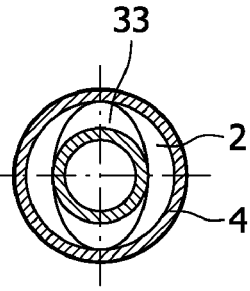

FIGS. 5A and 5B exemplary shows a fourth embodiment of a DBD lamp 1 according to the invention, similar to the third embodiment of FIGS. 4A and 4B, wherein a third ignition aid or igniter 33 is provided in the form of a closed clamp 33 which according to the cross sectional view of FIG. 5 substantially extends in the form of an ellipse between the inner wall 5 and the outer wall 6 within the discharge volume 2 and by this contacts both walls 4, 5. The third ignition aid or igniter 33 as well can be located at substantially any position along the axial length of the lamp 1.

Figure 6A:
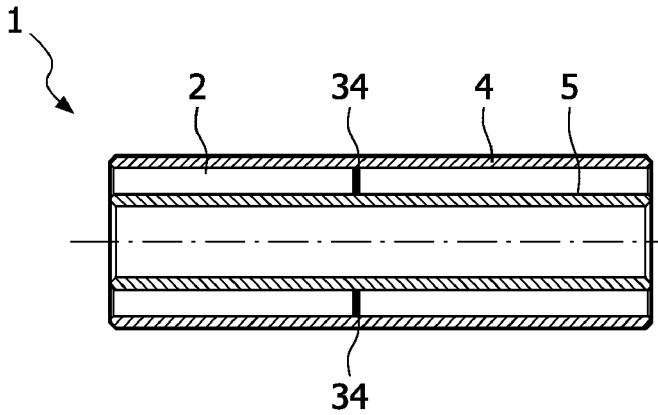
FIGS. 6A and 6B shows a longitudinal and a cross sectional view of substantial parts of a fifth embodiment of a coaxial DBD-lamp according to the invention.
Figure 6B:
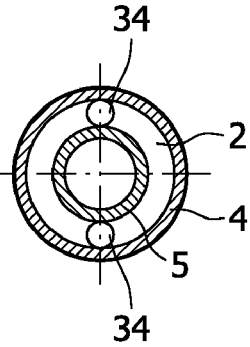

FIGS. 6A and 6B exemplary shows a fifth embodiment of a DBD lamp 1 according to the invention in which at least one, but preferably two fourth ignition aids or igniters 34 are provided, each in the form of a ring and/or a plate and/or a disk 34, which is/are positioned within the discharge volume 2, and which extend between adjacent sections of the inner wall 5 and the outer wall 4 for contacting the same. The preferably two rings, plates and/or disks 34 are preferably positioned opposite to each other within the annular discharge volume 2 as indicated in the cross sectional view of FIG. 6, so the radial angle between both in a circumferential direction is approximately 180°. However, three or more such rings, plates and/or disks 34 can be positioned as well with preferably equal distances in the circumferential direction of the discharge volume 2.

Furthermore, in case of using at least two of the fourth ignition aids or igniters 34, they are preferably, but not necessarily, positioned at the same axial position along the length of the lamp 1 (but again at substantially any position along the axial length of the lamp 1) as indicated in the longitudinal sectional view of FIG. 6.

Figure 7A:
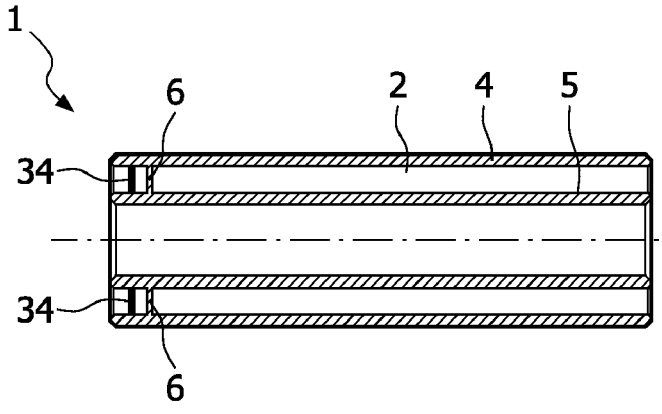
FIGS. 7A and 7B shows a longitudinal and a cross sectional view of substantial parts of a sixth embodiment of a coaxial DBD-lamp according to the invention.
Figure 7B:
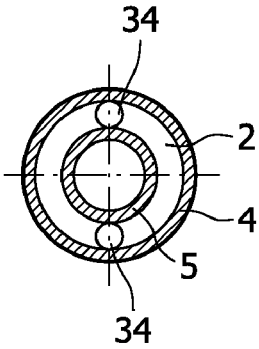

FIGS. 7A and 7B exemplary shows a sixth embodiment of a DBD lamp 1 according to the invention, which is similar to the fifth embodiment according to FIGS. 6A and 6B, in which, however, the discharge volume 2 comprises a sub-volume which is positioned at least one axial end of the lamp 1 and which comprises a discharge gas as well. The sub-volume is provided by means of a radiation-transparent separation wall 6, which separates the sub-volume from the remaining (main part of the) discharge volume 2.

The at least one fourth ignition aid or igniter 34 which is provided in the form of at least one ring and/or plate and/or disk 34 as in the fifth embodiment above, is positioned within this sub-volume. Regarding the number of rings and/or plates and/or disks 34 and the positioning along the discharge volume 2 in the circumferential direction of the DBD lamp 1, reference is made to the above explanations in connection with the fifth embodiment and FIGS. 6A and 6B.

If in this embodiment a gas discharge is ignited in the sub-volume, the photons generated by this gas discharge pass through the transparent separation wall 6 and utilize or support or stimulate the ignition of the main gas discharge in the main discharge volume 2.

A first, a second or a third ignition aid or igniter 31 to 33 as explained above with reference to FIGS. 2A and 2B to 5A and 5B, can as well be positioned within such a sub-volume.

Generally, the sub-volume is positioned at least one axial end of the DBD lamp 1, so that the radiation from the main gas discharge in the main discharge volume 2 is not shadowed or disturbed by the sub-volume. However, if this is not of particular relevance, the sub-volume could be provided as well at substantially any position along the axial length of the lamp, as is the case and indicated with respect to the ignition aids or igniters 31 to 34 in FIGS. 2A and 2*b*, 4A and 4B, 5A and 5B and 6A and 6B.

Finally, it is to be noted that the various ignition aids or igniters 31 to 34 which are shown in FIGS. 2A and 2B to 7A and 7B can be combined as well in one single embodiment of a DBD lamp 1 according to the invention. For example, at least one wire- or rod-like ignition aid or igniter 31 according to FIGS. 2A and 2B can be combined with at least one ring- or disk- or plate-like ignition aid or igniter 34 according to FIGS. 6A and 6B in one single lamp. Accordingly, other combinations are possible as well, wherein the different ignition aids or igniters 31 to 34 can be positioned at different axial positions along the length of the lamp 1 (including the axial ends according to FIGS. 3A and 3B and 7A and 7B) as well.

Furthermore, it is to be noted that the various ignition aids or igniters 31 to 34 according to the invention can be provided within a discharge volume 2 of a dielectric barrier discharge lamp 1 also in case that the discharge volume 2 is not provided by a coaxial arrangement of an inner and an outer tube, but by a dome shaped construction or other constructions. The principle of the invention and the functioning of the ignition aid or igniter 31 to 34 as explained above is not dependent on the disclosed coaxial arrangement of an inner and an outer tube, but can be applied in other arrangements and discharge volumes or discharge spaces as well.

While the invention has been illustrated and described in detail in the drawings and foregoing description, such illustration and description are to be considered illustrative or exemplary and not restrictive, and the invention is not limited to the disclosed embodiments. Modifications to embodiments of the invention described in the foregoing are possible without departing from the scope of the invention as defined by the accompanying claims.

Expressions such as "including", "comprising", "incorporating", "consisting of", "have", "is" used to describe and claim the present invention are intended to be construed in a non-exclusive manner, namely allowing for items, components or elements not explicitly described also to be present. Numerals included within parentheses in the accompanying claims are intended to assist understanding of the claims and should not be construed in any way to limit the subject matter claimed by these claims.

The invention claimed is:

1. Dielectric barrier discharge lamp, comprising a discharge volume (2) which is delimited by a first and a second wall (4, 5), wherein both walls (4, 5) are exposed to different electrical potentials by means of a first and a second electrode connected with a power supply (11) for exciting a gas discharge within the discharge volume (2), and at least one electrically conductive ignition aid or igniter (31 to 34) which extends within the discharge volume (2) and which electrically contacts the first and the second wall (4, 5) with each other so that a local short circuit of the discharge is achieved and a field emission of electrons is provided from the at least one ignition aid or igniter into the discharge volume.

2. Dielectric barrier discharge lamp according to claim 1, wherein the at least one electrically conductive ignition aid or igniter (31 to 34) comprises a material having a low electron affinity and/or a low energy barrier for the release of electrons such that electrons are released by field emission into the discharge volume (2) for decreasing the initial ignition voltage of the lamp (1).

3. Dielectric barrier discharge lamp according to claim 2, wherein the material comprises a metal.

4. Dielectric barrier discharge lamp according to claim 2, wherein the at least one electrically conductive ignition aid or igniter (31 to 34) comprises an elastic inner material and an outer material having the low electron affinity and/or the low energy barrier.

5. Dielectric barrier discharge lamp according to claim 1, wherein the at least one ignition aid or igniter is provided in the form of a substantially straight wire or rod (31).

6. Dielectric barrier discharge lamp according to claim 1, wherein the at least one ignition aid or igniter is provided in the form of a clamp (32; 33) which is formed for mechanical fixation due to elastic forces of the clamp (32; 33) exerted between the clamp (32; 33) and the adjacent first and second wall (4, 5) of the discharge volume (2).

7. Dielectric barrier discharge lamp according to claim 6, wherein the clamp (33) substantially extends in the form of an ellipse between the first and the second wall (4, 5) within the discharge volume (2).

8. Dielectric barrier discharge lamp according to claim 1, wherein the at least one ignition aid or igniter is provided in the form of at least one ring or plate or disk (34) which is positioned between the first and the second wall (4, 5) within the discharge volume (2).

9. Dielectric barrier discharge lamp according to claim 1, wherein the at least one ignition aid or igniter (31 to 34) is positioned within a sub-volume of the discharge volume (2), which sub-volume is separated from the discharge volume (2) by means of a radiation transparent separation wall (6).

10. Dielectric barrier discharge lamp according to claim 1, wherein the first and the second wall is provided by a coaxial arrangement of a first outer tube and a second inner tube, respectively.

* * * * *